United States Patent [19]

Weidman

[11] Patent Number: 4,936,494

[45] Date of Patent: Jun. 26, 1990

[54] TWO-FLAP CONTAINER CLOSURE

[75] Inventor: Craig C. Weidman, Wooster, Ohio

[73] Assignee: Weatherchem Corporation, Twinsburg, Ohio

[21] Appl. No.: 224,342

[22] Filed: Jul. 26, 1988

[51] Int. Cl.[5] ..... A47G 19/24

[52] U.S. Cl. ..... 222/480; 220/254; 220/339; 215/235; 215/237; 222/565

[58] Field of Search ..... 222/480, 556, 565, 545; 220/254, 339; 215/235, 237

[56] References Cited

U.S. PATENT DOCUMENTS

| | | | |
|---|---|---|---|
| 3,322,308 | 5/1967 | Foster | 222/480 |
| 4,693,399 | 9/1987 | Hickman et al. | 222/480 |
| 4,714,181 | 12/1987 | Kozlowski et al. | 222/480 |
| 4,721,221 | 1/1988 | Barriac | 215/350 |

*Primary Examiner*—Andres Kashnikow
*Assistant Examiner*—W. Todd Waffner
*Attorney, Agent, or Firm*—Pearne, Gordon, McCoy & Granger

[57] ABSTRACT

A shake-and-spoon cap for condiment containers and the like is formed of a one-piece injection-molded body. The cap provides a cylindrical skirt having inwardly projecting thread forms for mating with the male threads of a condiment container or the like. Two flaps are provided for selectively opening and closing a spoon opening and a plurality of shaker openings. The cap is structured so that the exposed end of the cap is a circular, planar surface when the flaps are closed. A sealing land inwardly spaced and concentric with the skirt is positioned to seal with the mouth of a container. The interior and exterior surfaces of the end wall are contoured so that substantially the entire cap has a uniform wall thickness. Peripherally spaced, radially extending ribs stiffen the cap between the land and the skirt to resist deflection and to ensure that the flap latching structure functions reliably.

14 Claims, 3 Drawing Sheets

TWO-FLAP CONTAINER CLOSURE

BACKGROUND OF THE INVENTION

This invention relates generally to closures for containers, and more particularly to an injection-molded plastic closure with hinged reclosable flaps.

PRIOR ART

U.S. Letters Pat. Nos. 4,693,399 and 4,714,181 both disclose injection-molded caps for condiment containers and the like of the "shake-and-spoon" type. The caps provide a generally semicircular spooning opening along one side sized so that a spoon can be inserted into the container to remove spoons full of container content. Along the other side of the cap are a plurality of relatively small apertures for shaking or sifting the container contents. The caps also provide two flaps or closures joined to the cap by a living hinge. One flap functions to selectively open or close the spooning opening and the other flap functions to open or close the shaking aperture. Letters Pat. No. 4,693,399 are assigned to the assignee of this invention. Both of such Letters Patent are incorporated herein by reference in their entirety.

When producing injection-molded parts such as the closure cap of the above-mentioned patents, it is highly desirable to structure the part to the maximum extent possible with a uniform wall thickness and to preferably form such wall thickness as thin as possible compatible with the part being produced.

When a part is produced of thermoplastic material, the material is molten when it is injected into the mold cavity and must cool and solidify within the cavity before it can be removed. During such cooling, such materials tend to shrink and if there is a nonuniformity in the wall thickness, or if substantially more material is located in one zone of the article than in another zone, the shrinkage that occurs during the cooling can result in gross distortions of the finished part. For example, if a circular part is to be produced, such as the cap of the present invention, the shrinkage can result in a finished part which is oval in shape and noncircular.

Further, in the zones of greatest wall thickness, the shrinkage tends to produce what is commonly referred to as "sinkholes," which often result in an unsatisfactory appearance in the finished part. Further, if substantial wall thicknesses are provided, the cooling and solidifying require more time, causing an increased "time-in-mold." This limits the production capacity for a given mold. Finally, if parts are produced with a greater thickness than required, the amount of material required to make a given part is increased and the cost of the product is increased.

The closure cap illustrated in U.S. Letters Pat. No. 4,714,181 provides a relatively thick skirt having female thread grooves formed therein proportioned to receive the male threads of a container. Such a thick skirt drastically increases the amount of material required to produce the cap and also presents very undesirable shrinkage problems which result when the injected molding material forming the cap shrinks during solidification.

The cap of Pat. No. 4,693,399, on the other hand, provides a cylindrical skirt having a thin wall thickness and a helical, inwardly projecting thread form which mates with the male thread of the container. The inner diameter of the skirt, except for the helical thread projections, is greater than the outer diameter of the male threads on the container. Such structure greatly reduces the amount of material required to produce a given cap and also provides a better finished cap because the shrinkage problems occurring during the molding of the cap are greatly reduced. Further, because the cap provides thinner wall sections, the time-in-mold is substantially reduced and higher molding outputs can be achieved for the given mold.

Since the inner diameter of the skirt, except for the helical thread projection, is greater than the outer diameter of the male threads on the container, and since the planar circular sealing surface provided by the container has a diameter substantially less than the maximum diameter of the male threads formed on the container, the cap must provide a sealing zone within the cap which is substantially spaced inward from the inner wall of the cylindrical skirt.

SUMMARY OF THE INVENTION

In accordance with this invention, a novel and improved closure cap is provided in which the thickness of the various portions of the cap are to the maximum extent maintained constant and thin. Therefore, material costs are minimized, shrinkage problems are minimized, and the in-mold time is minimized. In the illustrated embodiment, the spooning opening and the shaking apertures are substantially identical to corresponding parts disclosed and claimed in the '399 patent, supra. Further, the skirt is formed with a relatively thin cross section and provides inwardly extending helical projections to mate with the male threads of a container.

In accordance with the present invention, the underside of the cap is formed with a planar sealing land inwardly spaced from the inner wall of the cylindrical skirt and located to engage the planar sealing surface at the mouth of a container.

The wall of the cap between the sealing land and the skirt is configured to provide a substantially uniform, thin wall section so as to minimize the material content of the cap, minimize the problems of ovalization created by shrinkage, minimize sinkholes and the like, and reduce in-mold time.

Because the wall thickness in the zone between the cylindrical skirt and the sealing land is quite thin and subject to deflection if the cap is threaded tightly onto the container, peripherally located radial stiffening ribs are provided so that the latching of the two covers is not impaired by deflections in that zone. Consequently, proper latching and proper operation of the flaps is achieved even when the cap is applied to the container by automated capping equipment, and even after the cap has been removed and replaced by the user.

These and other aspects of this invention are illustrated in the accompanying drawings, and are more fully described in the following specification.

DETAILED DESCRIPTION OF THE DRAWINGS

Figure 1:
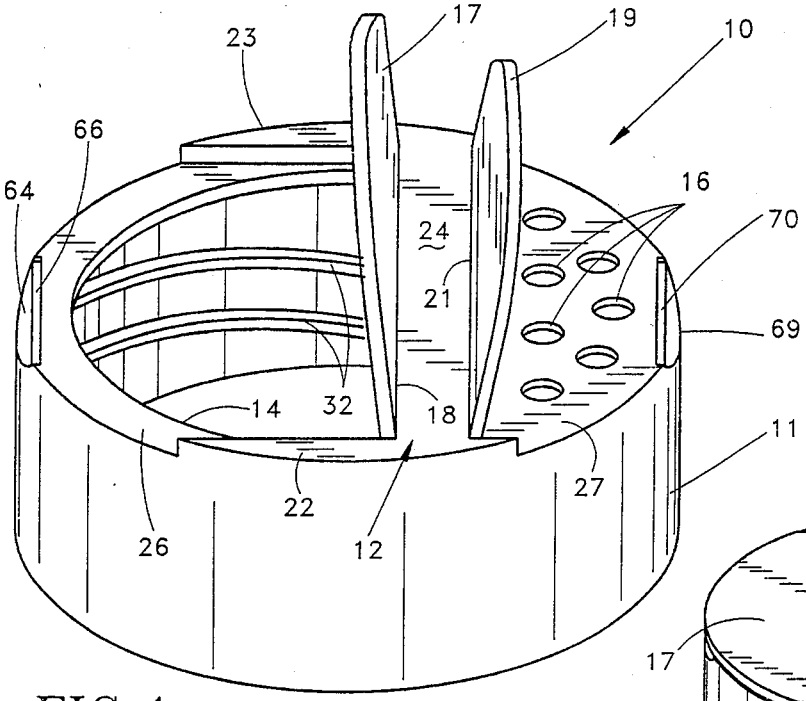
FIG. 1 is a perspective view of the condiment cap incorporating the present invention, illustrating the cap with the two flaps in the open position so as to expose the spooning opening and the shaking apertures to view.
Figure 3:
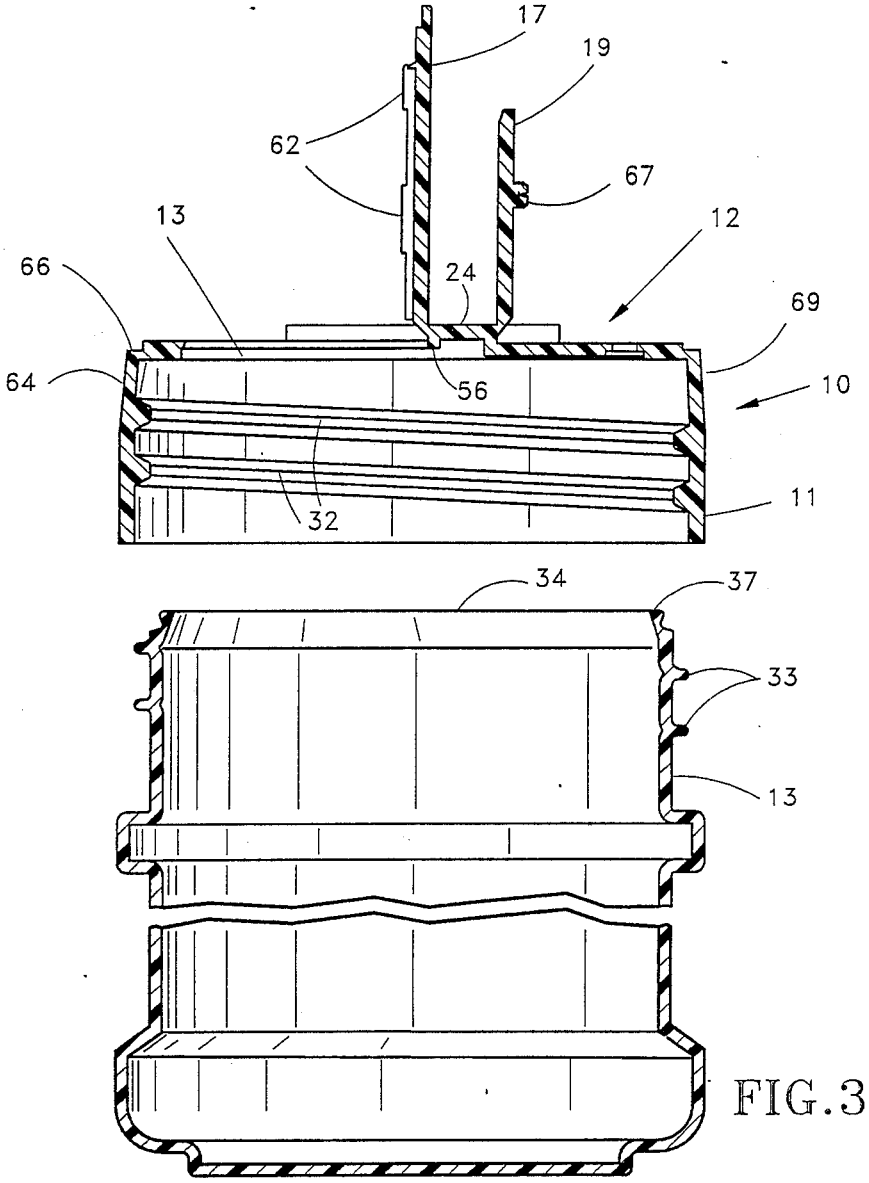
FIG. 3 is a cross section, taken along line 3—3 of FIG. 2, which is extended to illustrate the entire skirt structure of the cap.
Figure 4:
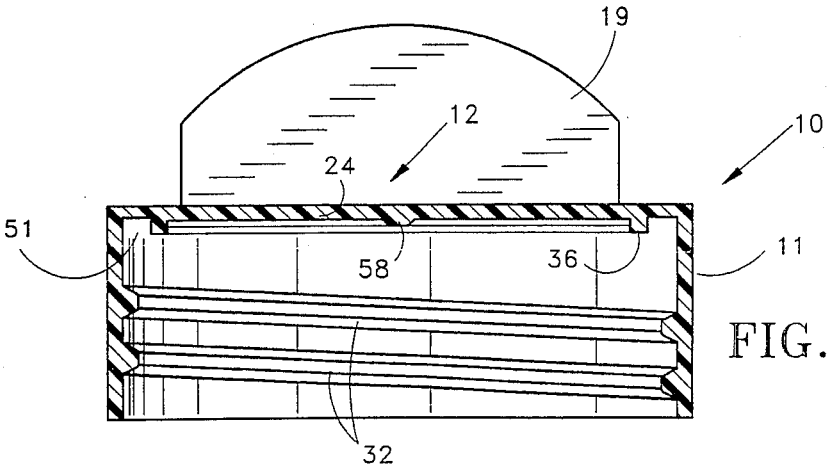
FIG. 4 is a cross section similar to FIG. 3, taken along line 4—4 of FIG. 2.

FIG. 1 illustrates the overall arrangement of the illustrated embodiment of a closure cap 10 in accordance with the present invention. The particular cap illustrated is a one-piece injection-molded body providing a cylindrical skirt 11 and a circular end wall 12. The cap when in use is threaded onto the mouth of a container 13 (illustrated in FIG. 3).

The illustrated embodiment is a shake-and-spoon-type cap often used with containers of spices or other condiments. The end wall 12 is formed with an enlarged, generally semicircular spooning opening 14 along one side and a plurality of relatively small shaker apertures 16 along the other side thereof. A first hinged flap 17 is integrally formed as a part of the body of the cap 10 and is connected by a living hinge for pivotal movement along a hinge line 18. The flap 17 is pivotally movable between an open position illustrated in FIG. 1 and a closed position illustrated in FIG. 1*a*, in which it tightly closes the spooning opening 14.

A latching structure (discussed in detail below) is provided to latch the first flap 17 in its closed position, and which is releasable to allow the flap to be pivoted to the open position illustrated in FIG. 1 so that a spoon can be inserted through the opening 14 into the associated container to remove spoons full of the contents from the container.

A second flap 19, also integrally formed with the body of the cap 10, is connected to the end wall 12 for pivotal movement by a living hinge extending along a hinge line 21. The second flap 19 is pivotally movable between the open position illustrated in FIG. 1 and a closed position illustrated in FIG. 1*a*, in which it closes and seals the shaker apertures 16. Here again, a latching structure, described in detail below, is provided to releasably secure the second flap 19 in its closed position.

Figure 1A:
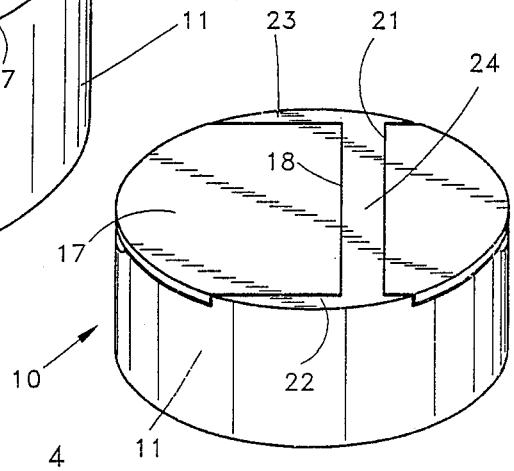
FIG. 1*a* is a perspective view similar to FIG. 1, but illustrating the flaps in their closed position.

The end wall 12 is contoured so that when the two flaps 17 and 19 are closed, the end wall cooperates with the flaps to provide a planar or flat, circular, exposed surface, as illustrated in FIG. 1*a*. To accomplish this, the end wall 12 is provided with laterally opposed, upwardly projecting portions 22 and 23 which are flush with a hinge support portion 24. Adjacent to the spooning opening 14, the end wall is provided with a first recessed portion 26 having an upper surface positioned below the surfaces of the projecting portions 22 and 23 an amount equal to the thickness of the first flap 17. Therefore, the exposed surface of the flap 17 is coplanar with the surfaces of the projecting portions 22 and 23 and with the surface of the hinge support portion 24 when the flap 17 is in its closed position.

Similarly, a second recessed portion 27, in which the shaker apertures 16 are formed, is recessed below the surface of the projecting portions 22 and 23 by a distance equal to the thickness of the flap 19. Therefore, when the second flap 19 is in its closed position, the exposed surface thereof is flush with the surface of the projecting portions 22 and 23 and the hinge support portion 24 to cooperate with these surfaces and the exposed surface of the first flap 17 and provide a smooth, planar, exposed surface when the two flaps are closed.

The interior wall 31 of the skirt is generally cylindrical, but is provided with inwardly extending, helical thread projections 32 positioned and sized to mate with exterior or male threads 33 adjacent to the mouth 34 of the container 13.

The cap 10 is molded from thermoplastic material by injection molding into a mold cavity of the type known to those skilled in the art. The thermoplastic material is heated to a fluid state prior to injection into the mold and is retained in the mold until it cools a sufficient amount to solidify and hold its shape.

During the cooling process during which the thermoplastic material solidifies, shrinkage occurs which can, if the cap is not properly structured, cause gross distortion of the cap when it is removed from the mold cavity. Such gross distortion can, for example, exhibit itself by producing an oval finished cap. Also, where a localized greater thickness is provided in the part, there is a tendency for a sinkhole to appear in the exterior surface of the finished product. Further, if relatively thick portions are provided, the time-in-mold must be increased so that the mass of thermoplastic material along the thickest part of the cap has sufficient time to solidify before the part can be removed from the mold. An increase in the time-in-mold required for the production of the particular part reduces the potential production of a given mold and is undesirable, particularly in a product of this type, which must be manufactured in extremely large quantities. Additionally, when thicker sections are provided, it is necessary to use additional material for the production of a given part, and the material cost of the part is increased.

In accordance with the present invention, the cap is structured to the maximum extent possible so as to provide a substantially uniform wall .thickness throughout the entire cap. This minimizes the time-in-mold and higher production capacities are possible with a given mold apparatus. Further, by arranging the structure of the cap so that a substantially uniform thickness is provided throughout the entire cap structure, the problems of distortion of the cap after it is removed from the mold and the problem of sinkholes are reduced. Still further, the illustrated embodiment of this invention is intended primarily for relatively large production required for the packaging of spices and other condiments for retail sales. Therefore, even small savings in the material requirements of the cap provide substantial savings in manufacturing costs.

The particular illustrated embodiment is sized for use with containers having a 53 mm. mouth size, which is one of the standard sizes in the container art for condiments. However, the illustrated embodiment can also be proportioned for use with 63 mm. containers which are customarily used for commercial sales of condiments to restaurants and the like. Further, in accordance with this invention, caps can be produced for other size containers which are conventionally used for the packaging of many materials of this general type.

The interior of the end wall 12 is provided with a circular and planar land 36 which is spaced a substantial distance in from the inner wall 31 of the skirt and is concentric therewith. This land is positioned to engage and seal with a planar, circular end wall 37 on the container 13 when the cap 10 is screwed onto the container 13. The land 36 is in the form of a downwardly projecting rib which extends down from the remaining portions of the end wall from a location 38 to 39 along one side of the cap interior and from the location 41 to the location 42 along the opposite side of the interior of the end wall.

Between the locations 39 and 41 and the locations 38 and 42, the land surface is coplanar with the inner surfaces 43 and 44, respectively, which join the land to the skirt 11 for the reasons discussed in greater detail below.

Figure 5:
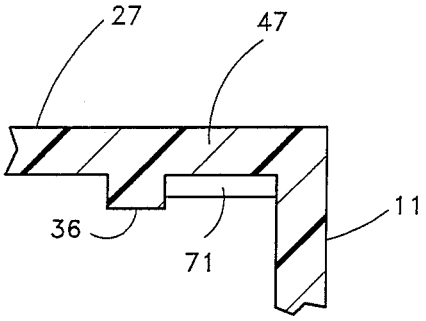
FIG. 5 is a greatly enlarged, fragmentary cross section, taken along line 5—5 of FIG. 2.

However, along the land portions from the location 38 to the location 46, the interior surface portion 47 is spaced back from the surface of the land 36 a small distance so-that the wall thickness along the surface portion 47 is equal to the wall thickness of the recessed portion 27. This is best illustrated in the enlarged fragmentary section of FIG. 5. Further, the wall thickness over the recessed surface portion 47 and the recessed portion 27 is preferably equal to the thickness of the adjacent portion of the skirt 11, as best illustrated in FIG. 5.

Figure 8:
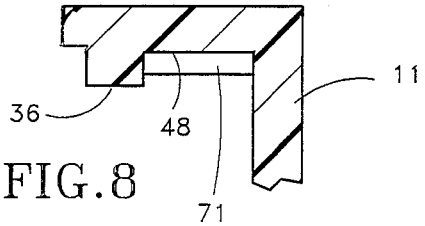
FIG. 8 is a greatly enlarged, fragmentary cross section taken along line 8—8 of FIG. 2.

A similar structural arrangement is provided adjacent to the spooning opening 14 where a recessed surface portion 48 is spaced back from the surface of the land 36 a small distance to provide a uniform wall thickness between the land 36 and the skirt 11 between the locations 49 and 39, as best illustrated in FIG. 8.

Figure 6:
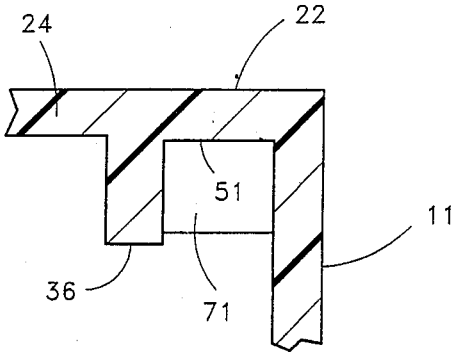
FIG. 6 is a greatly enlarged, fragmentary cross section taken along line 6—6 of FIG. 2.
Figure 7:
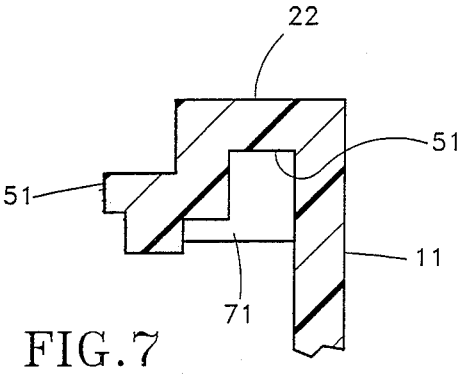
FIG. 7 is a greatly enlarged, fragmentary cross section taken along line 7—7 of FIG. 2.

Below the two upwardly projecting portions 22 and 23, the interior of the end wall is provided with a recessed surface portion 51 spaced back from the surface of the land 36 a greater distance so that the wall thickness along the upwardly projecting portions 22 and 23 is again equal to the thickness of the adjacent portion of the skirt 11, as best illustrated in FIGS. 6 and 7, and is equal to the wall thickness of the recessed portion 27.

As best illustrated in FIG. 7, the cap provides a short, inwardly extending lip 51 along the spooning opening 14. The lip 51 constitutes part of the latching system for releasably maintaining the first flap 17 in its closed position, as discussed in greater detail below.

Figure 9:
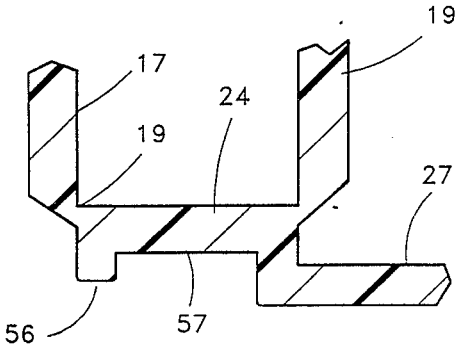
FIG. 9 is a greatly enlarged, fragmentary cross section taken along line 9—9 of FIG. 2.

The interior surface adjacent to the hinge support portion 24 is provided with a stiffening rib 56 extending substantially adjacent to the hinge line 19 for sup-port of the hinge of the flap 17, as best illustrated in FIG. 9. Adjacent to the stiffening rib 56, the interior wall 57 is recessed back so that the wall thickness along the hinge support portion 24 is also equal to the wall thickness of the recessed portion 27 and of the recessed portion 26.

Figure 2:
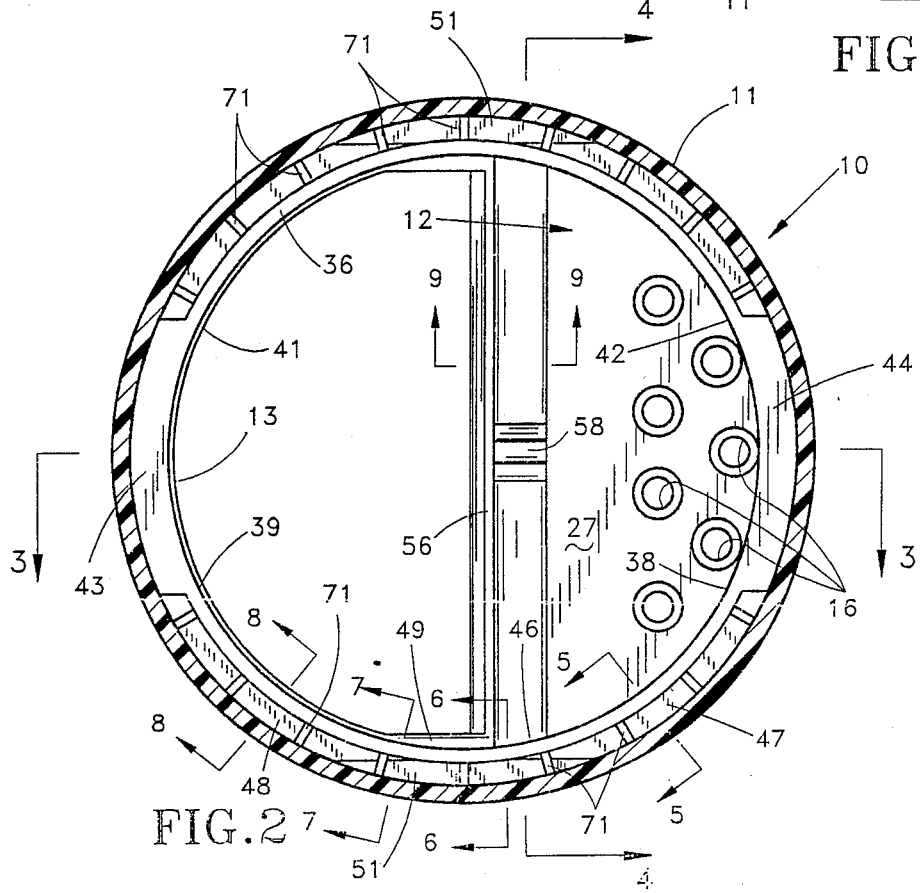
FIG. 2 is an interior view of the cap illustrated in FIG. 1, taken along a plane immediately above the thread projections formed in the skirt and illustrating the interior structure of the cap.

Located in the center of the hinge support portion 24 is a shallow, downwardly extending projection 58 (illustrated in FIG. 2) which serves as a gate through which the thermoplastic material is injected into the mold cavity during the molding process. This projection 58, however, is at its extremity recessed back from the inner surface of the rib 56 and the adjacent inner wall of the recessed portion 27 so that when the gate is broken away from the finished part, it does not project below such surfaces.

Figure 10:
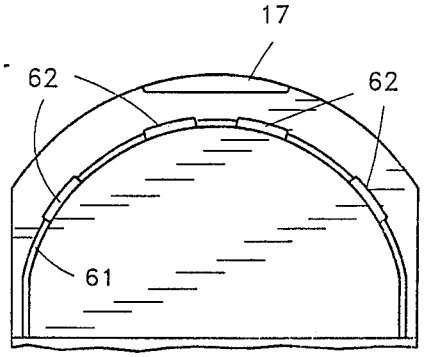
FIG. 10 is a fragmentary view of the underside of the flap which closes the spooning opening.
Figure 11:
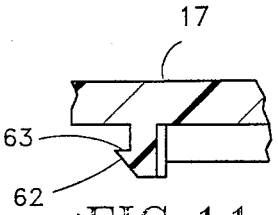
FIG. 11 is a greatly enlarged, fragmentary section taken generally along line 10—10 of FIG. 9, illustrating the spooning flap latching structure.
Figure 12:
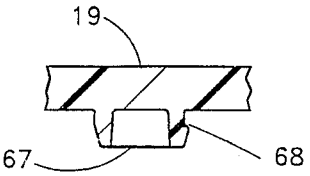
FIG. 12 is a greatly enlarged, fragmentary section illustrating the latching structure for the shaker flap.

The latching structure for the two flaps is best illustrated in FIGS. 11 and 12. As illustrated in FIG. 10, the interior of the flap 17 is provided with a generally semicircular rib 61 having latching projections 62 at four spaced locations thereon. These latching projections 62 have a shape best illustrated in FIG. 11 and provide a radially extending hook 63 adapted to project under the lip 52 illustrated in FIG. 7 around the spoon opening. These hooks releasably hold the flap 17 in the closed position and are sufficiently deflectable to permit the flap 17 to be released when it is desired to provide access to the interior of a container through the spoon opening. The wall of skirt 11 opposite the hinge line 18 is formed with a shallow inclined portion 64 and a shallow recess 66 to permit the user to insert a fingernail or a kitchen utensil under the edge of the flap 17 when it is desired to open the flap.

A latching structure is also provided for the flap 19. This includes a projection 67 positioned on the flap 19 to project through each of the adjacent apertures 16. Here again, these projections 67 are provided with very shallow hook portions 68 which extend under an associated ledge formed in the recessed wall portion 27 around the apertures 16.

The manner in which the latches are positioned and operated is more fully described in the Pat. No. 4,693,399, incorporated by reference above, and reference should be made to such patent for a more detailed description of the operation of such latches.

The skirt along the centerline opposite the hinge line 21 is inclined back a small amount and provided with shallow recesses 69 and 70 similar to the recesses 64 and 66, to permit the user to insert a fingernail or utensil under the flap 19 for opening such flap. The land 36 is spaced in from the skirt 11 by at least about twice the wall thickness of the cap portion joining them.

It has been found that there is a tendency for the portion of the end wall 12 between the land 36 and the skirt to deflect slightly if the cap is threaded tightly onto the container. Such deflection tends to cause the flap latching systems to malfunction. Therefore, the cap is provided with a plurality of peripherally spaced, radially extending ribs 71 extending between the land 36 and the adjacent portions of the skirt 11 to resist such deflections and to prevent malfunction of the latch even when the cap is relatively tightly applied to the container. Similarly, the end wall 12 adjacent to the surface portions 43 and 44 is provided with a slight increase in thickness to provide additional resistance to such deflection. The presence of these ribs 71, however, does not present a problem with respect to shrinkage, and requires only a slight additional amount of material. Preferably, such ribs 71 are spaced back from the surface of the land 36 a very slight amount.

In accordance with this invention, a cap structure is provided which can be produced by injection molding thermoplastic material as a one-piece structure so that a fully formed cap is produced during each injection operation with a minimum amount of time-in-mold so that high production rates can be achieved. Further, since virtually the entire cap has a uniform thickness, the shrinkage problems are minimized and gross distortion does not occur; hence, objectionable sinkholes are not produced. In addition, zones of localized weakness do not exist even though relatively thin wall sections are provided. For example, in the illustrated embodiment, a wall thickness of 0.05 inch is provided along substantially the entirety of the cap, with the exception of the land 36 and thread projection 32. Also, because the portion of the end wall between the skirt 11 and the land 36 is reinforced by the ribs 71 and the wall portions 43 and 44, the cap can be applied by automated assembly equipment without jeopardizing the operation of the latching system for the flaps.

In the illustrated embodiment, the hinge supporting portion 24 is offset from the center of the cap to enlarge the spooning opening 14 to provide sufficient area for ease of insertion and removal of a spoon. However, sufficient numbers of shaking apertures 16 are provided even though the area in which they are positioned is less than the area of the spooning opening.

Although the preferred embodiment of this invention has been shown and described, it should be understood that various modifications and rearrangements of the parts may be resorted to without departing from the scope of the invention as disclosed and claimed herein.

What is claimed is:

1. A dispensing cap for a container comprising an injection-molded plastic one-piece body providing a circular end wall and a cylindrical skirt extending from one face of said end wall, said end wall providing at least one opening therein through which contents of an associated container can be removed without removing said cap from said container, said body providing a hinged flap operable to close said opening, said end wall and flap providing latch means for holding said cap closed, a relatively flat sealing land extending from the interior surface of said end wall and being spaced radially inwardly from said skirt and connected to said skirt by an end wall portion, said sealing land providing a region for sealing a circular mouth of the container, said skirt providing internal threads for mating with male threads on said associated container for mounting said cap thereon, threading said cap on said associated container causing the mouth of the container to press on the sealing land and producing forces along the periphery of said end wall in a direction substantially normal to said end wall tending to produce deflection of said end wall portion tending to cause said latch means to malfunction, and a plurality of reinforcing ribs extending below said end wall portion radially between said sealing land and skirt, said reinforcing ribs being disposed on the inner periphery of the skirt at a multitude of relatively closely spaced locations whereby said reinforcing ribs provide an anchoring action for said end wall portion and sealing land by imparting the inherent stiffness of the cylindrical skirt, and indirectly the container mouth portion threaded into it, to the end wall portion and sealing land to resist deflection in said end wall portion to prevent malfunction of said latch means.

2. A cap as set forth in claim 1, wherein substantially all of said end wall and skirt provide a substantially uniform wall thickness equal to said wall portion.

3. A cap as set forth in claim 1, wherein said flap and end wall cooperate to provide a substantially planar exposed surface when said flap is closed.

4. A cap as set forth in claim 3, wherein said end wall provides a recessed portion sized to receive said flap, said end wall providing projections adjacent to said recessed portion projecting above said recessed portion, the interior surface of said end wall within said projections being recessed to maintain a substantially uniform wall thickness along said end wall.

5. A cap as set forth in claim 1, wherein said end wall provides an opening along one side to accept a spoon and a plurality of small shake openings along the opposite side, said cap providing two flaps for selectively closing said openings.

6. A cap as set forth in claim 1, wherein said land is spaced from said skirt by a distance at least equal to about twice the thickness of said wall portion.

7. A cap as set forth in claim 6, wherein said land provides a planar sealing surface spaced inwardly beyond the remainder of said end wall.

8. A cap as set forth in claim 1, wherein said end wall is contoured to cooperate with said flap to provide a smooth planar exposed surface on said cap when said flap is closed, and the inner surface of said end wall is contoured to provide substantially all of said end wall with a substantially uniform wall thickness.

9. A two-mode dispensing cap for a container comprising an injection-molded thermoplastic one-piece body, said body providing a circular end wall and a cylindrical skirt extending from one face of said end wall, said cylindrical skirt having thread means for engaging mating threads adjacent the mouth of an associated container, said end wall having along one side a spooning opening sufficiently large to allow passage of a spoon for spooning out contents from said associated container and a shake dispensing side along another side of said end wall containing a plurality of relatively small apertures for dispensing therethrough the contents of said associated container, a first hinged flap on said body for selectively closing said spooning opening, a second hinged flap on said body for selectively closing said relatively small apertures, and end wall and flaps providing cooperating releasable latch means normally maintaining said flaps closed, said end wall being contoured so that said end wall and flaps cooperate to provide a substantially planar and circular exterior surface when said flaps are closed, said end wall also providing a relatively flat sealing land inwardly spaced from said skirt having a region adapted to engage the seal with the mouth of said associated container, said end wall providing a wall portion of limited thickness joining said sealing land and said skirt, threading said cap on said associated container producing forces along the periphery of said end wall in a direction substantially normal to said end wall tending to produce deflection of said wall portion tending to cause malfunction of said latch means, and a plurality of peripherally spaced radially extending reinforcing ribs extending below said wall portion radially between said sealing land and skirt, said reinforcing ribs being disposed on the inner periphery of the skirt at a multitude of relatively closely spaced locations whereby said reinforcing ribs provide an anchoring action for said end wall portion and sealing land by imparting the inherent stiffness of the cylindrical skirt, and indirectly the container mouth portion threaded into it, to the end wall portion and sealing land to resist deflection of said wall portion and preventing malfunction of said latch means.

10. A cap as set forth in claim 9, wherein said end wall provides an interior surface contoured to provide substantially all of said end wall with a uniform wall thickness.

11. A cap as set forth in claim 10, wherein substantially all of said end wall and skirt have a uniform wall thickness.

12. A cap as set forth in claim 11, wherein said land is spaced from said skirt a distance at least equal to about twice said uniform wall thickness.

13. In combination, a container adapted to be filled with granular material and having a mouth with threads extending around said mouth substantially adjacent thereto, a dispensing cap for said container consisting of an injection-molded plastic one-piece body providing a circular end wall and a cylindrical skirt having thread means engaging the threads of said container, said end wall providing at least one opening therein through which contents of said container can be removed without removing said cap from said container, said body providing a hinged flap operable to close said opening, said end wall and flap providing latch means for holding said flap closed, said cap providing a sealing surface inwardly spaced from said cylindrical skirt engaging said mouth of said container and forming a seal therewith, the periphery of said end wall being subjected to a force substantially normal to said end wall when said cap is tightened onto said container tending to cause deflection of said end wall and tending to cause said latch means to malfunction, and a plurality of reinforcing ribs extending below said end wall radially between said sealing surface and said skirt, said reinforcing ribs being disposed on the inner periphery of the skirt at a multitude of relatively closely spaced locations, said sealing surface being a circumferentially continuous annulus spaced radially inward of the ribs and lying in a flat plane whereby said reinforcing ribs provide an anchoring action for said end wall and sealing surface by imparting the inherent stiffness of the cylindrical skirt, and indirectly the container mouth portion threaded into it, to the end wall and sealing surface to resist deflection of said periphery of said end wall to prevent malfunction of said latch means.

14. A dispensing cap for a container having a mouth and threads adjacent said mouth comprising an injection-molded plastic one-piece body providing a circular end wall and a cylindrical skirt extending from one side of said end wall, said cylindrical skirt providing thread means for engaging said threads adjacent said mouth of said container, said end wall providing at least one opening therein through which contents of said container can be removed without removing said cap from said container, said body providing a hinged flap operable to close said opening, said end wall and flap providing latch means for holding said flap closed, a sealing surface along the interior surface of said end wall spaced inwardly from said skirt for engaging said mouth of said container and forming a seal therewith, tightening of said cap onto said container producing forces along the periphery of said end wall in a direction substantially normal to said end wall tending to cause deflection of said peripheral portion of said end wall and also tending to cause said latching means to malfunction, and a plurality of reinforcing ribs extending below said end wall radially between said sealing surface and skirt, said reinforcing ribs being disposed on the inner periphery of the skirt at a multitude of relatively closely spaced locations, said sealing surface being a circumferentially continuous annulus spaced radially inward of the ribs and lying in a flat plane whereby said reinforcing ribs provide an anchoring action for said end wall and sealing surface by imparting the inherent stiffness of the cylindrical skirt, and indirectly the container mouth portion threaded into it, to the end wall and sealing surface to resist deflection of said periphery of said end wall to prevent malfunction of said latch means.

* * * * *